United States Patent [19]

McCartney et al.

[11] Patent Number: 4,520,739

[45] Date of Patent: Jun. 4, 1985

[54] NOZZLE TIP FOR PULVERIZED COAL BURNER

[75] Inventors: Michael S. McCartney, Bloomfield; Roman Chadshay, Windsor; Richard F. Erlacher, Simsbury, all of Conn.

[73] Assignee: Combustion Engineering, Inc., Windsor, Conn.

[21] Appl. No.: 555,462

[22] PCT Filed: Jul. 12, 1982

[86] PCT No.: PCT/US82/00940

§ 371 Date: Sep. 13, 1982

§ 102(e) Date: Sep. 13, 1982

[87] PCT Pub. No.: WO84/00314

PCT Pub. Date: Feb. 2, 1984

[51] Int. Cl.[3] ..... F23D 1/00

[52] U.S. Cl. ..... 110/263; 239/587; 239/591; 239/600

[58] Field of Search ..... 110/263, 264, 347; 122/479 B; 239/587, 590, 591, 600

[56] References Cited

U.S. PATENT DOCUMENTS

| | | | |
|---|---|---|---|
| 2,895,435 | 7/1959 | Bogot et al. | 239/587 |
| 4,274,343 | 6/1981 | Kokkinos | 110/347 X |
| 4,304,196 | 12/1981 | Chadshay et al. | 110/263 X |

FOREIGN PATENT DOCUMENTS

| | | | |
|---|---|---|---|
| 134342 | 3/1953 | Japan . | |
| 310555 | 4/1929 | United Kingdom | 110/263 |

*Primary Examiner*—Edward G. Favors

*Attorney, Agent, or Firm*—William W. Habelt

[57] ABSTRACT

An improved nozzle tip (10) for a burner on a pulverized coal-fired furnace for receiving a stream of pulverized coal and air discharging from the coal delivery pipe (50) of the burner and directing the pulverized fuel and air stream into the furnace, is comprised of a base body (20), a replaceable highly abrasion resistant insert (30), and a replaceable highly temperature resistant end cap (40) which is readily attachable by mechanical means (28, 48) to the base body with the abrasion resistant insert disposed therein. The insert defines a highly abrasion resistant flow conduit through the nozzle tip from the discharge end of the base body to the receiving end of the end cap through which the pulverized fuel and air stream passes from the burner into the furnace.

13 Claims, 3 Drawing Figures

NOZZLE TIP FOR PULVERIZED COAL BURNER

BACKGROUND OF THE INVENTION

The present invention relates to burner nozzle tips adapted for use in pulverized-coal fired furnaces and, more particularly, to a nozzle tip for pulverized coal-fired burner having a replaceable cast insert of highly abrasion resistant material and a replaceable end cap of temperature resistant material.

One common method of firing coal in conventional coal-fired steam generating boiler furnaces is known as tangential firing. In this method pulverized coal is introduced into the furnace in a primary air stream through burners, frequently termed fuel-air admission assemblies, located in the corner windboxes of the furnace. The pulverized coal-air streams discharging from these burners are aimed tangentially to an imaginary circle in the middle of the furnace to create a massive flame therein termed a fireball.

Upon leaving the furnace proper, the combustion products formed in the fireball pass through a boiler section typically housing a superheater, a reheater, and other various heat absorption surfaces to cool the combustion products and generate superheated steam. By changing the position of the fireball formed in the furnace upon convergence of the fuel-air streams emanating from the burners, control of the temperature of the steam leaving the superheater or reheater is achieved. By tilting the burner nozzle tips in unison the fireball can be physically raised or lowered within the furnace so as to increase or decrease the heat absorption of the furnace waterwalls thereby raising or lowering the temperature of the combustion products leaving the furnace proper and passing over the superheater and reheater surface. As the temperature of the combustion products entering the boiler section changes, the temperature of the steam generated in the heat absorption surface disposed therein changes proportionately. Such a method of steam temperature control is shown in U.S. Pat. No. 2,363,875 to Kreisinger et al.

A typical coal-air admission assembly or burner employed heretofore on tangentially-fired furnaces comprises a coal delivery pipe, often termed a coal nozzle, through which pulverized coal entrained in a primary air stream is delivered to the furnace, an air conduit surrounding the coal delivery pipe through which additional air is delivered to the furnace, and a nozzle tip pivotally mounted to the coal delivery pipe so as to be tiltable in a vertical plane whereby the pulverized coal-air stream being delivered to the furnace through the coal delivery pipe and the additional air passing through the air conduit can be selectively directed into the furnace as dictated by steam temperature requirements.

A typical prior art burner nozzle tip, such as that shown in U.S. Pat. No. 2,895,435 to Bogot et al, was formed of a steel open-ended inner shell defining a flow passage through which the pulverized coal-air stream from the coal delivery pipe is delivered into the furnace and a steel open-ended outer shell spaced from and surrounding the inner shell so as to define therebetween an annular duct through which the air leaving the air conduit is directed into the furnace. Additionally, one or more steel or stainless steel baffles, termed splitter plates, are typically disposed within the inner shell of the nozzle tip and aligned parallel to the longitudinal axis thereof, to impart additional directional force to the coal-air stream discharging through the inner shell and to insure a uniform distribution of the coal-air stream particularly when the nozzle is tilted away from the horizontal for steam temperature control.

A major problem heretofore encountered in using such nozzle tips has been the rapid wear of the steel or stainless steel splitter plates due to extreme erosion caused by the impingement of coal particles entrained in the high velocity air stream passing from the coal delivery pipe. As these splitter plates wear away, they lose their ability to adequately direct the pulverized-coal air stream into the furnace, thus detracting from the effectiveness of the tip. Additionally, coal particles impinge upon the walls of the inner shell when the nozzle tips are tilted away from the horizontal resulting in increased and more rapid wear of the inner shell itself.

The nozzle tip is also exposed to heat from the flame in the furnace. Prior art nozzle tips have been susceptible to cracking due to exposure to this heat particularly where the splitter plates are welded to the inner shell or where the inner shell is welded to the outer shell.

A burner nozzle tip is disclosed in U.S. Pat. No. 3,823,875 which is alleged to overcome the aforementioned problems by providing a burner nozzle tip which is formed of an outer shell of particularly heat resistant stainless steel and an inner shell of particularly erosion resistant stainless steel both of which are fabricated by casting and not welding and which are assembled and held together mechanically to form the nozzle tip rather than being welded together. In order to replace the inner shell, which although made of a more erosion resistant stainless steel still must be replaced sooner than the outer shell, the nozzle tip must be completely removed from the coal nozzle itself and the inner shell pulled rearwardly from the outer shell. Then a new inner shell must be inserted within the outer shell and the entire coal nozzle tip again attached to the coal nozzle. This is a cumbersome and time-consuming operation which, as it must be done when the furnace is out of operation, may unnecessarily extend the downtime of the furnace.

Therefore, it is an object of the present invention to provide an improved nozzle tip for a pulverized coal-fired burner which incorporates a replaceable highly erosion resistant insert that defines a flow passage for directing pulverized coal entrained in primary air from the coal delivery pipe into the furnace and a replaceable highly temperature resistant end cap which is mounted to the end of the nozzle tip exposed to the high temperatures generated within the furnace.

It is a further object of the present invention to provide such an improved burner nozzle tip which is readily disassembleable from the interior of the furnace without detaching the entire nozzle tip body from the coal delivery pipe of the burner.

It is still another object of the present invention to provide a replaceable, weld-free, cast insert of highly abrasion resistant material and a replaceable end cap of highly temperature resistant material adapted to mate with the nozzle tip body and be secured thereto by mechanical means rather than welding.

SUMMARY OF THE INVENTION

In accordance with the present invention, an improved nozzle tip for a burner on a pulverized coal-fired furnace for receiving a stream of pulverized fuel and air discharging from the coal delivery pipe of the burner and directing said pulverized fuel and air stream into the furnace is comprised of a base body, a replaceable highly abrasion resistant insert, and a replaceable highly temperature resistant end cap which is readily attachable by mechanical means to the base body so as to facilitate disassembly of the nozzle tip for replacement of either the insert or the end cap.

A hollow, open-ended, replacement insert of a highly abrasion resistant material is disposed intermediate of the base body and the end cap and retained in position therebetween. The insert defines a highly abrasion resistant flow conduit through the nozzle tip from the discharge end of the base body to the receiving end of the end cap through which the pulverized fuel and air stream passes from the burner into the furnace.

The base body is adapted to be mounted to the coal delivery of the coal delivery pipe by mechanical means. In a preferred embodiment, the base body comprises a hollow, open-ended outer shell pivotally mounted to the discharge end of the burner and a hollow, open-ended inner shell disposed substantially coaxially in spaced relationship within the outer shell so as to define a first flow passage through the interior of the inner shell and a second flow passage through the annular space between the inner and outer shell. Preferably, the base body is formed of a highly abrasion resistant stainless steel.

The abrasion resistant insert for lining the coal nozzle tip comprises a hollow, open-ended, weld-free shell cast of an abrasion resistant material, preferably in the shape of a frustum of a rectangular pyramid defining therethrough a tapering flow path. Preferably, at least one integrally cast, weld-free splitter plate is disposed within the flow passage of the insert so as to subdivide the flow passage into multiple passages through which the pulverized coal and primary air stream may be directed into the furnace.

The replaceable end cap comprises a hollow, open-ended outer shell and a hollow, open-ended inner shell disposed substantially coaxially in spaced relationship within the outer shell so as to define a first flow passage through the inner shell and a second flow passage through the annular space between the inner and outer shells. A plurality of plate-like members disposed transversely between the inner and outer shells extend therefrom for engaging and mounting to the base body of the coal nozzle tip. Preferably the replaceable end cap is formed of stainless steel which is particularly temperature resistant.

In assembly, the removable end cap is removably attached to the base body of the nozzle tip with the abrasion resistant insert secured therebetween so as to mate the inlet end of the inner shell of the end cap with the outlet end of the abrasion resistant insert and the outlet end of the inner shell of the base body with the inlet end of the abrasion resistant insert so as to define a first flow passage through the inner shell of the base body, through the interior of the open-ended insert, and through the inner shell of the end cap. Additionally, the inlet end of the outer shell of the replaceable end cap mates with the outlet end of the outer shell of the base body so as to define a second flow passage through the annular space between the inner and outer shells of the base body and the inner and outer shells of the replaceable end cap. The pulverized coal and primary air being supplied to the furnace from the burner discharge passes through the first flow passage and the secondary air being supplied to the furnace passes through the second flow passage.

BRIEF DESCRIPTION OF THE PREFERRED EMBODIMENT

Figure 1:
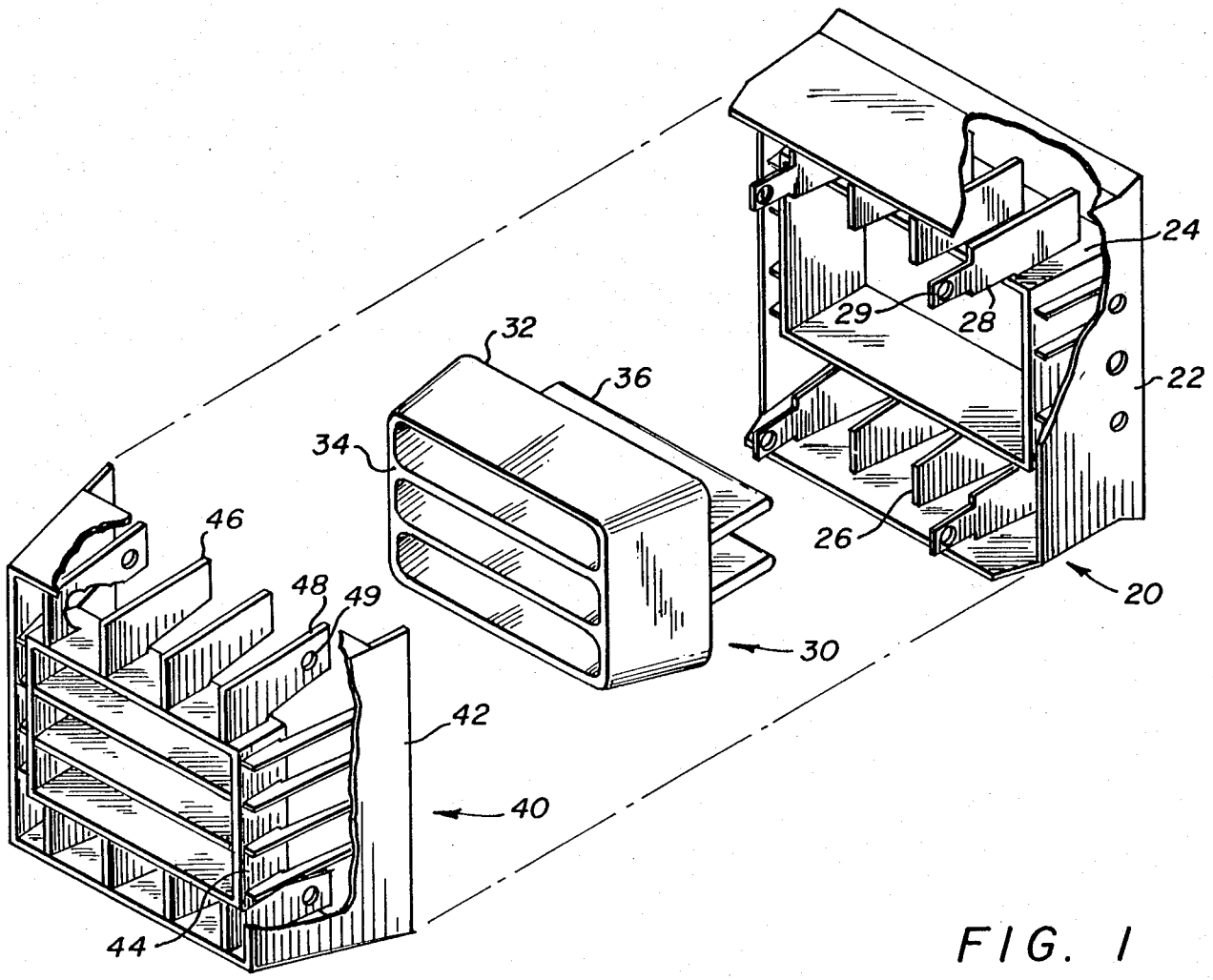
FIG. 1 is a perspective view showing the improved nozzle tip of the present invention in disassembly with the parts thereof in alignment for assembly.
Figure 3:
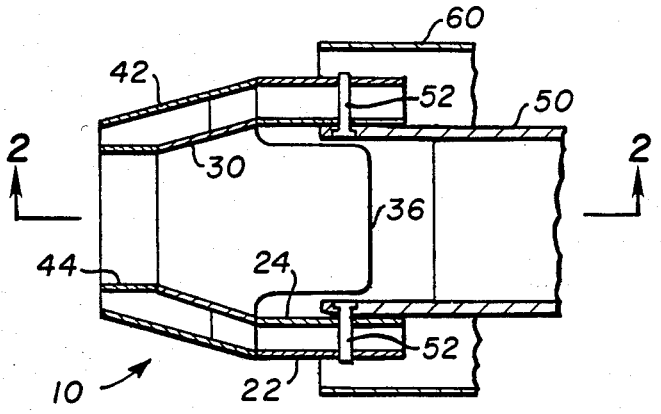
FIG. 3 is a cross-section plan view taken along line 3—3 of FIG. 2 showing the nozzle tip of the present invention assembled and attached to a typical fuel-air admission assembly employed on a pulverized coal-fired furnace utilizing tangential firing.
Figure 2:
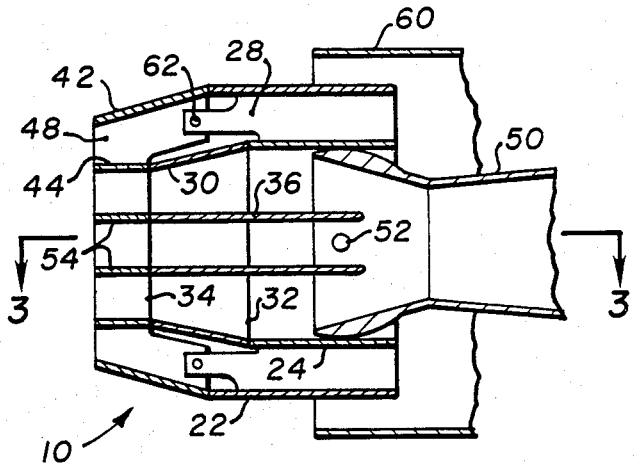
FIG. 2 is a cross-sectional side elevation view taken along line 2—2 of FIG. 3 showing the nozzle tip of the present invention assembled and mounted to a typical fuel-air admission assembly employed on a pulverized coal-fired furnace utilizing tangential firing.

Referring now to the drawing, there is depicted therein an improved nozzle tip 10 constructed in accordance with the present invention. As shown in FIG. 1, burner nozzle tip 10 comprises a base body 20, a replaceable abrasion resistant insert 30 and a replaceable end cap 40. In FIG. 1, the burner nozzle tip 10 is shown disassembled with its components in alignment for assembly. In FIGS. 2 and 3, the burner nozzle tip 10 is shown attached to a coal delivery pipe 50 of a fuel-air admission assembly, i.e. burner, of the type typically employed on a pulverized coal-fired furnace utilizing tangential firing, although the nozzle tip 10 of the present invention may be readily incorporated into other burner configurations without departing from the spirit and scope of the present invention.

The nozzle tip 10 of the present invention is comprised of three components; the base body 20, the replaceable abrasion resistant insert 30 and the replaceable end cap 40, which are assembled so as to be readily detachable for disassembly for replacement of the abrasion resistant insert 30 or the end cap 40. The hollow, open-ended base body 20 is adapted to be mounted, preferably pivotally, to the discharge end of the coal delivery pipe 50. The replaceable, hollow, open-ended end cap 40 is mounted to the base body 20 at the discharge end thereof in a readily detachable manner, such as, but not limited to, bolting, pinning, tack welding and other well known techniques.

A replaceable, hollow, open-ended weld-free insert 30 cast of a highly abrasion resistant material is disposed intermediate of the base body 20 and the end cap 40 and retained in position therebetween by the end cap 40 being secured to the base body 20. The insert defines a highly abrasion resistant flow conduit through the nozzle tip from the outlet end of the base body 20 to the inlet end of the end cap 40. The pulverized coal and air stream passes from the coal delivery pipe 50 through the base body 20, thence through the abrasion resistant insert 30 and thence through the end cap 40 into the furnace.

Functionally, the burner nozzle tip 10 serves to provide a means for imparting a directional force to the pulverized coal discharging from the coal delivery pipe 50 and to the air being delivered to the furnace from the windbox 60. The base body 20 is adapted to fit around the discharge end of the coal delivery pipe 50 and is pivotally mounted thereto. The nozzle 10 is tiltable about an axis transverse to the longitudinal axis of the coal delivery pipe 50 in order that the position of the fireball within the furnace may be changed to effect steam temperature control. In its normal position, the nozzle tip 10 is positioned with its longitudinal axis aligned with the longitudinal axis of the coal delivery pipe 50, which is generally horizontally disposed. In order to raise the fireball within the furnace, the nozzle tip 10 would be rotated about the pivot pin 52 so as to tilt upward, thereby causing both the pulverized coal-air stream and the secondary air stream to be directed upward. Similarly, if the fireball is to be lowered within the furnace, the nozzle tip 10 would be rotated about the pivot pin 52 so as to tilt downward, thereby causing both the pulverized coal-air stream and the secondary air stream to be directed downward.

In practice, it is necessary for the discharge end of the nozzle tip 10 to extend slightly into the furnace. Therefore, the discharge end of the nozzle tip 10 is exposed to high temperatures and heat transfer from the flame within the furnace. Additionally, the coal particles in the primary air and pulverized coal stream discharging from the coal delivery pipe 50 and passing through the nozzle tip 10 are highly abrasive and subject the interior surfaces of the nozzle tip 10 to severe erosion caused by coal particles impinging upon them particularly when the nozzle tip 10 is tilted away from the longitudinal axis of the coal pipe 50.

In accordance with the present invention, an improved nozzle tip 10 is provided which has a replaceable heat resistant end cap 40 and a replaceable abrasion resistant insert 30 for lining the interior of the nozzle tip 10. The replaceable end cap 40 is preferably formed of a highly heat resistant stainless steel so that the end cap 40 will have a longer lifetime in the furnace environment and at the same time protect the rest of the nozzle tip, particularly the cast insert 30, from the heat generated in the furnace. The abrasion resistant insert 30 is a one piece cast of a highly abrasion resistant material, preferably Ni-Hard, although silicon carbide or highly abrasion resistant stainless steel may also be used. The abrasion resistant insert 30 serves to protect the end cap 40 from impingement by the coal particles in the pulverized coal and primary air stream discharging from the coal delivery pipe 50 through the nozzle tip 10.

Therefore, by providing a heat resistant end cap 40 to protect the abrasion resistant insert 30 from the heat generated in the furnace and by providing an abrasion resistant insert 30 to protect the heat resistant end cap 40 from the erosion caused by the coal particles in the pulverized coal and air stream discharging through the nozzle tip 10, the lifetime of the nozzle tip in the furnace environment can be greatly increased since the selection of the materials to form the heat resistant end cap 40 and the nozzle insert 30 can be optimized. That is, the material selected to form the end cap 40 can be selected solely based upon its heat resistant properties without consideration of its abrasion resistant properties, while the material selected to form the abrasion resistant insert 30 can be selected solely on the basis of its abrasion resistant properties without consideration of its heat resistant properties.

In the best mode embodiment presently comtemplated, as shown in FIGS. 1, 2 and 3, the hollow, open-ended base body 20 of the nozzle tip 10 is comprised of an outer shell 22 and an inner shell 24 disposed substantially coaxially in spaced relationship within the outer shell 22 so as to define a first flow passage through the hollow interior of the inner shell 24 and a second flow passage through the annular space between the inner and outer shell. Preferably, a plurality of plate-like support ribs 26 are disposed transversely between the inner and outer shells of the base body 20 to increase the structural integrity of the base body.

As best seen in FIG. 3, the base body 20 is mounted to the discharge end of the coal delivery pipe 50 of the pulverized coal burner. Preferably, the base body 20 is pivotally mounted to the discharge end of the coal delivery pipe 50 by means of pivot pins 52 or the like. The pulverized coal and primary air discharging from the coal delivery pipe 50 passes through the hollow interior of the inner shell 24 of the base body 20 and into the abrasion resistant insert 30, while the secondary air discharging from the windbox 60 passes through the annular space between the inner and outer shells of the base body 20 and into the removable end cap 40.

The replaceable, hollow, open-ended end cap 40 preferably comprises an outer shell 42 and an inner shell 44 disposed substantially coaxially in spaced relationship within the outer shell 42 so as to define a first flow passage through the hollow interior of the inner shell 44 and a second flow passage through the annular space between the inner and outer shells of the replaceable end cap 40. Preferably, a plurality of plate-like support ribs 46 are disposed transversely between the inner and outer shells of the end cap 40 to increase the structural integrity of the end cap. Additionally, preferably at least one splitter plate 54 is disposed within the inner shell 44 of the end cap 40 substantially parallel to the longitudinal axis of the coal delivery pipe 50 so as to subdivide the inner shell into multiple passages.

As mentioned previously, it is preferred that the removable end cap 40 be made of a stainless steel which is particularly temperature or heat resistant. The replaceable end cap 40 is removably attached to the base body 20 with the abrasion resistant insert 30 secured therebetween. The removable end cap 40 is attached to the base body 20 so that the outer shell 42 of the end cap 40 mates with the outer shell 22 of the base body 20 thereby defining a secondary air flow conduit through which secondary combustion air passes from the windbox 60 through the annular passage between the inner and outer shells of the base body 20 and thence through the annular passage between the inner and outer shells to the removable end cap 40 and into the furnace.

In the preferred embodiment, the means of removably attaching the end cap 40 to the base body 20 comprises a first plurality of plate-like members 28 disposed transversely between the inner shell 24 and the outer shell 22 of the base body 20 so as to extend therefrom in a direction toward the end cap 40, and a second plurality of plate-like members 48 disposed transversely between the inner shell 44 and the outer shell 42 of the end cap 20 so as to extend therefrom in a direction towards the base body 20. Holes 29 and 49 are drilled in the plate-like members 28 and 48 respectively so that the hole 49 in the plate-like members 48 of the replaceable end cap 40 coincide with the holes 29 in the plate-like members 28 of the base body 20 when the replaceable end cap 40 is mated to the base body 20. As best seen in FIG. 2, removable securing means 62, such as but not limited to pins or bolts, are passed through the coincident holes 29 and 49 of the first and second plate-like members 28 and 48 to detachably mount the end cap 40 to the base body 20.

As mentioned previously, a replaceable, hollow, open-ended weld-free insert 30 cast of a highly abrasion resistant material is disposed intermediate the base body 20 and the end cap 40 when the nozzle is assembled. The cast insert 30 is aligned such that its inlet end 32 mates with and abuts against the outlet end of the inner shell 24 of the base body 20 and its outlet end 34 mates with and abuts against the inlet end of the inner shell 42 of the replaceable end cap 40 thereby defining a flow conduit through which pulverized coal and primary air discharging from the coal delivery pipe 50 passes through the interior of the inner shell 22 of the base body 20 into and through the cast insert 30 and thence through the interior of the inner shell 42 of the end cap 40 into the furnace.

Because the cast insert 30 is disposed completely internally within the nozzle 10 and protected from exposure to the heat generated by the flame within the furnace by the replaceable end cap 40, the cast insert 30 can be made of a material selected solely based upon its abrasion resistant properties without concern for its heat resistant properties. Accordingly, it is preferred that the abrasion resistant insert 30 be cast of a highly abrasion resistant material such as Ni-Hard, silicon carbide or stainless steel which is particularly highly abrasion resistant.

Preferably, the abrasion resistant cast insert 30 is comprised of a hollow, open-ended, weld-free shell in the shape of a frustum of a rectangular pyramid so as to define therethrough a flow passage tapering inwardly from the inlet end 32 to the outlet end 34 of the cast insert 30. Additionally, at least one integrally cast, weld-free splitter plate 36 is disposed within the tapering flow passage substantially parallel to the longitudinal axis of the coal delivery pipe 50 so as to subdivide the tapering flow passage of the cast insert 30 into multiple passages. Additionally, it is preferred that the splitter plates 36 disposed within the integrally cast insert 30 extend externally therefrom through the inlet end 32 of the frustum shaped shell.

The abrasion resistant insert 30 is disposed within the nozzle tip 10 with its outlet edge 34 abutting against the inner shell 42 of the removable end cap 40 and with its inlet end 32 abutting against the inner shell 24 of the base body 20. Thus, when the nozzle tip 10 is tilted downward, the abrasion resistant insert 30 is prevented from falling into the furnace by the replaceable end cap 40 and, similarly, when the nozzle tip 10 is tilted upward, the abrasion resistant insert 30 is prevented from falling back into the coal delivery pipe 50 by the base body 20. Further, it is preferred that the support ribs 46 and the plate-like members 48 disposed between the inner and outer shells of the replaceable end cap 40 be machined along their inner surface so as to mate with and engage the lateral surface of the abrasion resistant insert 30 disposed intermediate the end cap 40 and the base body 20 to further secure the abrasion resistant insert 30 in place during operation.

Accordingly, the present invention provides an improved nozzle tip 10 for a pulverized coal fired burner which is expected to possess a longer useful lifetime than prior art nozzle tips in the high temperature and extremely erosive environment associated with pulverized coal firing. The cast insert 30 which defines the tapering portion of the pulverized coal flow passage through the nozzle tip 10 is made of a highly abrasion resistant material. It is better equipped to withstand the impingement of coal particles flowing through the nozzle tip and will have a much longer lifetime in the erosive environment.

Additionally, because the cast insert 30 is protected from the hostile furnace environment by the highly temperature resistant end cap 40, the material selection for the cast insert 30 can be optimized to provide a highly abrasion resistant material to further extend the useful lifetime of the nozzle tip. Further, because the cast insert 30 serves to protect the highly temperature resistant end cap 40 from impingement by the coal particles flowing through the nozzle tip 10, the material selection for the replaceable end cap 40 can also be optimized so that a very highly temperature and heat resistant material can be utilized in forming the replaceable end cap 40 again extending the useful lifetime of the nozzle tip 10.

Still further, because the cast insert 30 and the replaceable end cap 40 are detachably mounted to the base body 20, and only the base body 20 is mounted to the coal delivery pipe 50, the nozzle tip 10 is readily serviceable from the interior of the furnace so that the cast insert 30 and the replaceable end cap 40 can be readily removed and replaced when necessary during normal furnace shutdowns in a very short period of time.

While the preferred embodiment of the present invention has been illustrated and described in the best mode presently contemplated as incorporated into a fuel-air emission assembly of the type typically employed on a tangentially-fired furnace, it is to be understood that the invention should not be limited thereto. The nozzle tip of the present invention could be readily adapted by those skilled in the art so as to be applied to any number of burner configurations wherein pulverized coal or other abrasive solid fuels are combusted without departing from the spirit and scope of the present invention as set forth in the claims appended hereto.

We claim:

1. A nozzle tip for a burner on a pulverized fuel-fired furnace for receiving a stream of pulverized fuel and air discharging from the burner and directing said pulverized fuel and air stream into the furnace, comprising:

a. a hollow, open-ended base body adapted to be mounted to the discharge end of the burner having an outer shell and an inner shell disposed substantially coaxially in spaced relationship within the outer shell so as to define a first flow passage through the interior of the inner shell and a second flow passage through the annular space between the inner and outer shells;

b. a replaceable, hollow, open-ended end cap removably mounted to said base body at the discharge end thereof and having an outer shell and an inner shell disposed substantially coaxially in spaced relationship within the outer shell so as to define a first flow passage through the interior of the inner shell and a second flow passage through the annular space between the inner and outer shells; and c. a replaceable, hollow, open-ended insert of a highly abrasion resistant material disposed intermediate of said base body and said end cap and retained in position therebetween by said base body and said end cap, said insert having an inlet end mating with an abutting against the discharge end of the inner shell of said base body and an outlet end mating with and abutting against the receiving end of the inner shell of said end cap, said insert defining a highly abrasion resistant flow conduit through the nozzle tip from the discharge end of the first flow passage of said base body to the receiving end of the first flow passage of said end cap through which the pulverized fuel and air stream passes from the burner into the furnace.

2. A nozzle tip for a burner on a pulverized fuel-fired furnace for receiving a stream of pulverized fuel and air discharging from the burner and directing said pulverized fuel and air stream into the furnace, comprising:

a. a hollow, open-ended base body adapted to be pivotally mounted to the discharge end of the burner having an outer shell and an inner shell disposed substantially coaxially in spaced relationship within the outer shell so as to define a first flow passage through the interior of the inner shell and a second flow passage through the annular space between the inner and outer shells;

b. a replaceable, hollow, open-ended end cap having an outer shell and an inner shell disposed substantially coaxially in spaced relationship within the outer shell so as to define a first flow passage through the interior of the inner shell and a second flow passage through the annular space between the inner and outer shells;

c. a replaceable, hollow, open-ended, weld-free insert cast of a highly abrasion resistant material having an inlet end and an outlet end, said cast insert disposed intermediate of said base body and said end cap with its inlet end mating with and abutting against the discharge end of the inner shell of said base body and its outlet end mating with and abutting against the receiving end of the inner shell of said end cap thereby defining a first flow conduit formed of the first flow passage of said base body, the interior of said cast insert and the first flow passage of said end cap through which the pulverized fuel and air stream passes from the burner into the furnace; and d. means for removably attaching said end cap to said base body with said cast insert secured therebetween so as to mate the outer shell of said end cap with the outer shell of said base body thereby defining a second flow conduit formed of the second flow passage of said base body and the second flow passage of said end cap through which additional air passes into the furnace.

3. A nozzle tip as recited in claim 2 wherein said replaceable, hollow, open-ended, weld-free, cast insert is tapered inwardly from its receiving end adjacent said base body to its discharge end adjacent said end cap thereby defining an inwardly tapering flow conduit through the nozzle tip from the discharge end of said base body to the receiving end of said end cap.

4. A nozzle tip as recited in claim 3 wherein said means for removably attaching said end cap to said base body comprises:

a. first plurality of plate-like members disposed transversely between the inner and outer shells of said base body and extending therefrom in a direction toward said end cap, said first members having a hole therethrough;

b. a second plurality of plate-like members disposed transversely between the inner and outer shells of said end cap and extending therefrom in a direction toward said base body, said second members having a hole therethrough disposed so as to coincide with the hole in one of said first members when said end cap is mated to said base body; and c. removable securing means disposed through the coincident holes of said first and second members for mounting said end cap to said base body.

5. A nozzle tip as recited in claim 4 wherein each of the second plurality of plate-like members disposed transversely between the inner and outer shells of said end cap and extending therefrom in a direction toward said base body engages the lateral surface of said cast insert disposed intermediate said end cap and said base body.

6. A nozzle tip as recited in claims 2, 3, 4 or 5 wherein said base body is comprised of stainless steel which is particularly abrasion resistant and said replaceable end cap is comprised of stainless steel which is particularly temperature resistant.

7. A nozzle tip as recited in claim 6 wherein said replaceable, hollow, open-ended, weld-free, cast insert is cast as a single piece of Ni-Hard material.

8. An abrasion resistant insert for lining a coal nozzle tip comprising a hollow, open-ended, weld-free shell cast of abrasion resistant material in the shape of a frustum of a rectangular pyramid defining therethrough a tapering flow passage, said shell having at least one integrally cast, weld-free splitter plate disposed within the tapering flow passage so as to subdivide the tapering flow passage into multiple passages.

9. An abrasion resistant insert as recited in claim 8 wherein the splitter plate disposed within the tapering flow passage extends externally therefrom through the larger of the open ends of the frustum shaped shell.

10. An abrasion resistant insert as recited in claim 8 or 9 wherein said insert is cast as a single piece of Ni-Hard material.

11. A replaceable end cap for mounting to a coal nozzle tip comprising:

a. a hollow, open-ended outer shell;

b. a hollow, open-ended inner shell disposed substantially coaxially in spaced relationship within the outer shell so as to define a first flow passage through the inner shell and a second flow passage through the annular space between the inner and outer shells;

c. at least one splitter plate disposed within the inner shell so as to subdivide the first flow passage therethrough into multiple passages; and d. a plurality of plate-like members disposed transversely between the inner and outer shells and extending therefrom for engaging and mounting to said coal nozzle tip.

12. A replaceable end cap is recited in claim 11 comprised of stainless steel which is particularly temperature resistant.

13. An abrasion resistant insert for lining a coal nozzle tip comprising a hollow, open-ended shell of abrasion resistant material in the shape of a frustum of a rectangular pyramid defining therethrough a flow passage, said shell having at least one splitter plate disposed within the flow passage so as to subdivide the flow passage into multiple passages, said splitter plate extending externally from the flow passage through the larger of the open ends of the frustum shaped shell.

* * * * *